US007843301B2

(12) United States Patent
Shoji et al.

(10) Patent No.: US 7,843,301 B2
(45) Date of Patent: Nov. 30, 2010

(54) COIL COMPONENT AND METHOD AND APPARATUS FOR PRODUCING THE SAME

(75) Inventors: Atsushi Shoji, Tokyo (JP); Makoto Morita, Tokyo (JP); Masatoshi Shindoh, Tokyo (JP); Masatoshi Ozawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/213,783

(22) Filed: Jun. 24, 2008

(65) Prior Publication Data

US 2009/0002112 A1 Jan. 1, 2009

(30) Foreign Application Priority Data

Jun. 27, 2007 (JP) ..... 2007-168782

(51) Int. Cl.
*H01F 27/29* (2006.01)

(52) U.S. Cl. ..... 336/192

(58) Field of Classification Search ..... 336/65, 336/83, 84 R, 84 M, 192, 198, 200, 232–233
See application file for complete search history.

(56) References Cited

U.S. PATENT DOCUMENTS

| | | | | |
|---|---|---|---|---|
| 7,071,803 | B2 * | 7/2006 | Oki | 336/83 |
| 7,515,028 | B1 * | 4/2009 | Sato et al. | 336/200 |
| 2006/0267716 | A1 * | 11/2006 | Peng et al. | 336/83 |

FOREIGN PATENT DOCUMENTS

| | | |
|---|---|---|
| JP | A-3-163808 | 7/1991 |
| JP | A-2005-210055 | 8/2005 |
| JP | A-2005-217280 | 8/2005 |
| JP | A-2006-114536 | 4/2006 |
| JP | A-2007-173573 | 7/2007 |
| JP | A-2007-173576 | 7/2007 |

* cited by examiner

*Primary Examiner*—Tuyen Nguyen
(74) *Attorney, Agent, or Firm*—Oliff & Berridge, PLC

(57) ABSTRACT

A coil component having a core including a winding portion, and first and second flanges disposed one on either end of the winding portion, A winding is wound about the winding portion, and first and second terminal electrodes are disposed on the first flange. The first flange has an octagonal shape including a bottom surface, a first peripheral surface, first and third omitted peripheral surfaces disposed one on either side of the first peripheral surface, a second peripheral surface opposing the first peripheral surface, and second and fourth omitted peripheral surfaces disposed one on either side of the second peripheral surface. The first terminal electrode is disposed across the first omitted peripheral surface, a part of the bottom surface in a region connecting the entire first omitted side to the entire third omitted side, and the third omitted peripheral surface. The second terminal electrode is disposed across the second omitted peripheral surface, a part of the bottom surface in a region connecting the entire second omitted side to the entire fourth omitted side, and the fourth omitted peripheral surface. The winding has a first end electrically connected to the first terminal electrode on the first omitted peripheral surface and a second end electrically connected to the second terminal electrode on the second omitted peripheral surface.

7 Claims, 8 Drawing Sheets

COIL COMPONENT AND METHOD AND APPARATUS FOR PRODUCING THE SAME

TECHNICAL FIELD

The present invention relates to a coil component and a method and apparatus for manufacturing the same, and particularly to a coil component for a power supply system that has a low height or profile and is suitable for high-density mounting and to a method and apparatus for producing such a coil component.

BACKGROUND

Coil components provided with a drum core having a pair of flanges and a winding portion connecting the pair of flanges are well known in the art. However, the requirements for high-density mounting in electronic devices such as mobile telephones have become more stringent in recent years with the increase in high performance. Therefore, efforts are being made to reduce the volume and height of coil components, as well as the gap between adjacent coil components, as disclosed in Japanese patent application publication No. 2005-210055.

When the winding is electrically connected to terminal electrodes at the mounting surface, the height of the coil is increased by the height of the connection. The above reference also describes forming a depression in the mounting surface and connecting a winding within this depression. However, since the shape of the core is more complex in this case, the core is more difficult to manufacture, and the strength of the core may be lowered.

Further, the mounting portion of the coil cannot be seen when the coil component is mounted on the circuit board and when the electrically connecting portions of winding to the terminal electrodes is directly facing the circuit board. In order to make the electrically connecting portions to be visible, terminal electrodes are provided on the peripheral surface of the flange. However, this sometimes causes short-circuiting between electrode parts when adjacent coil components are placed close together. As a result, adjacent coil components must be separated a certain distance in this case, which is problematic when striving for high-density mounting. Further, it has also been difficult to ensure the integrity of the electrical connections between the terminal electrodes and a land pattern on the circuit board.

Japanese patent application publication No. 2006-114536 discloses a method of manufacturing a coil component in which a conductive wire with an insulating coating is used as a winding wound about the winding portion of the drum core, and a resin containing magnetic powder is firmly fixed about the winding so as to fill the gap between the flanges. In this manufacturing method, the magnetic powder-containing liquid resin is first introduced into a recess formed in a metal die. Next, the gap between the flanges is filled with this resin by inserting, into the recess, the drum core with the winding wound about the winding portion thereof.

However, when inserting the drum core into the recess in the conventional manufacturing method described above, the resin can overflow from the recess and become deposited on undesirable parts, such as the terminal electrodes provided on the drum core.

Further, since the resin flows quickly about the winding wound around the winding portion, air within the winding does not have sufficient time to escape, trapping many air bubbles in the resin filling the gap between the flanges.

SUMMARY

In view of the foregoing, it is an object of the present invention to provide a coil component having a low height, capable of being mounted at a high density, and capable of ensuring the integrity of electrical connections between electrodes and a circuit board.

It is another object of the present invention to provide a method and apparatus for manufacturing coil components capable of preventing resin from overflowing from a recess in the die and capable of sufficiently allowing air within the winding to escape.

These objects of the present invention will be attained by a coil component including a core, a winding, and terminal electrodes. The core includes a winding portion, and first and second flanges disposed one on either end of the winding portion. The winding is wound about the winding portion. The terminal electrodes are disposed on the first flange. The first flange has a bottom surface constituting a first endface of the core, and a peripheral surface extending toward a second endface of the core from a peripheral edge of the bottom surface. The bottom surface is formed in an octagonal shape when viewed along a line connecting the first flange and the second flange and has a first omitted side, second omitted side, third omitted side, and fourth omitted side configured by chamfering or cutting an imaginary square-shaped bottom surface at a position corresponding to a first corner located on a first end of a first side forming the bottom surface, a position corresponding to a second corner located on a first end of a second side opposing the first side, a position corresponding to a third corner located on a second end of the first side, and a position corresponding to a fourth corner located on a second end of the second side. The peripheral surface has surfaces corresponding to all sides of the octagonal bottom surface, including a first peripheral surface extending from the first side, a second peripheral surface extending from the second side, a first omitted peripheral surface extending from the first omitted side adjacent to the first peripheral surface, a second omitted peripheral surface extending from the second omitted side adjacent to the second peripheral surface, a third omitted peripheral surface extending from the third omitted side adjacent to the first peripheral surface, and a fourth omitted peripheral surface extending from the fourth omitted side adjacent to the second peripheral surface. The terminal electrodes includes a first terminal electrode and a second terminal electrode, the first terminal electrode being disposed across the first omitted peripheral surface, a part of the bottom surface covering at least a region linking an entire length of the first omitted side to an entire length of the third omitted side, and the third omitted peripheral surface, and the second terminal electrode being disposed across the second omitted peripheral surface, a part of the bottom surface covering at least a region linking an entire length of the second omitted side to an entire length of the fourth omitted side, and the fourth omitted peripheral surface. The winding has a first end electrically connected to the first terminal electrode on the first omitted peripheral surface, and has a second end electrically connected to the second terminal electrode on the second omitted peripheral surface.

With the above construction, the ends of the winding are electrically connected to portions of the outer peripheral surface on the first flange and are not connected to the bottom surface at which the coil component is mounted. Therefore, the height of the coil component is defined merely by the distance from one endface of the core to the other endface, enabling the core component to be formed at a low height. Thus, the height of the coil component can be reduced by the diameter of the winding from the height of a coil component having the winding connected to the bottom surface of the flange. Put another way, the volume of the core can be increased by an amount equivalent to the height of a single winding.

Since the flange is octagonal in shape and ends of the winding are electrically connected to the first and second omitted peripheral surfaces constituting the outer peripheral surface of the flange, solder fillets can be formed between the electrodes and the circuit board, while ensuring the minimum mounting surface area, and thus the coil components can be mounted at a high density. Put another way, the first and second omitted peripheral surfaces are positioned between an imaginary plane including the first peripheral surface and an imaginary plane including the second peripheral surface. This construction reduces the likelihood of the first and second omitted peripheral surfaces from contacting other coil components, even when neighboring coil components contact each other at the first or second peripheral surface. Hence, by reducing the likelihood of solder fillets formed on the terminal electrodes from contacting other coil components during mounting, the occurrence of short circuits can be prevented, even when the gaps between neighboring coil components are narrow.

Further, by setting the electrode forming regions to a region on the bottom surface linking the entire length of the first omitted side to the entire length of the third omitted side and a region on the bottom surface linking the entire length of the second omitted side to the entire length of the fourth omitted side, the electrode surface area can be maximized to enhance the strength of the bonds between the electrodes and the land pattern on the circuit board when mounting the coil component. Further, increasing the surface area of the electrodes opposing the land pattern on the circuit board can enhance self-alignment of coil components during the reflow soldering process.

Preferably, the first end of the winding and the first terminal electrode on the first omitted peripheral surface, and the second end of the winding and the second terminal electrode on the second omitted peripheral surface are electrically connected to each other through diffusion bonding. Examples of diffusion bonding include thermocompression bonding, welding such as low-resistance welding and laser welding, and ultrasonic bonding. In other words, the connections are formed by diffusion bonding rather than soldering. If the wires were connected with solder, the solder could conceivably melt from the heat generated during the reflow process, allowing the wires to become disconnected from the electrodes. However, connections formed by diffusion bonding do not melt from the heat of reflow, and thus the wire connections can be maintained.

The first terminal electrode is disposed only on the first and third omitted peripheral surfaces among the octagonal peripheral surface, and the second terminal electrode is disposed only on the second and fourth omitted peripheral surfaces among the octagonal peripheral surface. Accordingly, this construction can prevent short-circuiting between neighboring coil components while minimizing the mounting surface area.

Preferably, a resin part is provided for covering a wound portion of the winding. The resin can protect the winding. Preferably, the resin part contains magnetic powder. By adjusting the mixture ratio of ferrite powder or other magnetic powder to resin, the properties of the coil component can be freely set as required.

Preferably, a resin part is provided for covering an entire second flange and an entire wound part of the winding, whereas the peripheral surface and bottom surface of the first flange is free from covering with the resin part. Hence, nearly the entire drum core can be protected by a layer of resin.

Preferably, the bottom surface further has a third side connecting the first and second omitted sides and a fourth side connecting the third and fourth omitted sides, and the first terminal electrode is disposed in a region of the bottom surface extending to a first borderline connecting a point on the third side to a point on the fourth side, and the second terminal electrode is disposed in a region of the bottom surface extending to a second borderline connecting a different point on the third side to a different point on the fourth side, the first and second borderlines being separated from each other. Hence, it is possible to ensure maximum connection area between the electrodes and the land pattern on the circuit board, provided that there are no short-circuits between the first and second terminal electrodes.

In another aspect of the invention, there is provided a method of manufacturing a coil component including a die preparation step, an introducing step, a resin supplying step, and a hardening step. The die preparation step is provided for preparing a die having a resin supplying cell capable of storing a liquid resin, a coil part accommodating cell capable of accommodating at least part of a coil part constituting a coil component, and a communicating part providing communication between the resin supplying cell and the coil part accommodating cell. The introducing step is provided for introducing at least a part of the coil part into the coil part accommodating cell. The resin supplying step is provided for supplying a liquid resin into the resin supplying cell in order to introduce the liquid resin through the communicating part into the coil part accommodating cell accommodating at least the part of the coil part. The hardening step is for hardening the liquid resin in at least the coil part accommodating cell.

By performing the introducing step for inserting at least a portion of the coil part in the coil part accommodating cell and the resin supplying step for supplying liquid resin into the resin supplying cell so that liquid resin flows through the communicating part into the coil part accommodating cell accommodating at least the portion of the coil part, the desired area of the coil part is filled with a sufficient amount of resin. Hence, the coil part can be provided with a sufficient amount of resin in the desired area through simple steps, without performing such complex steps as supplying resin to the desired area a plurality of times. Further, this method enhances the properties of the coil component and reduces variations in properties among individual components, while protecting the desired area.

By supplying an appropriate amount of liquid resin in the resin supplying step, it is possible to prevent the liquid resin from overflowing from the coil part accommodating cell, thereby preventing liquid resin from becoming deposited on areas of the coil part other than the desired area. Further, since the liquid resin flows from the resin supplying cell into the coil part accommodating cell via the communicating part, the liquid resin can gradually cover the desired area of the coil part, minimizing the amount of air bubbles that may be involved in the resin part covering the coil part.

Preferably, a level of the liquid resin is controlled at a prescribed position when the liquid resin is accumulated in the resin supplying cell, the communicating part, and the coil part accommodating cell as a result of supplying the liquid resin to the resin supplying cell in the resin supplying step to introduce liquid resin into the coil part accommodating cell through the communicating part. By maintaining the level of liquid resin at the prescribed position while liquid resin has accumulated in the resin supplying cell, communicating part, and coil part accommodating cell, the resin can be provided to the desired position on the coil part with great accuracy.

Preferably, the level of liquid resin in the resin supplying cell is controlled at the prescribed position in the resin supplying step. In order to maintain the level of liquid resin in the resin supplying cell at the prescribed position in the resin supplying step, the resin supplying cell and coil part accommodating cell can be left open to the atmosphere so that the levels of resin in the resin supplying cell and the coil part accommodating cell can be matched, enabling the level of the resin in the coil part accommodating cell to be set at the prescribed position by setting the level of resin in the resin supplying cell at the prescribed position. Hence, by setting the level of resin in the resin supplying cell to the prescribed position, it is possible to control the level of the resin where the coil part is set. Therefore, in situations where managing the level of liquid resin in the coil part accommodating cell is difficult, the level of fluid in the coil part accommodating cell can be managed indirectly by managing the level of fluid in the resin supplying cell.

Preferably, the level of liquid resin in the coil part accommodating cell is controlled at the prescribed position in the resin supplying step. By controlling the liquid resin in the coil part accommodating cell at the prescribed level in the resin supplying step, the level of liquid resin in the coil part accommodating cell can be managed with great accuracy so that resin is more accurately provided at the desired position on the coil part.

Preferably, preheating step is provided for preheating the die and the coil part prior to performing the resin supplying step. Since the die and the coil part are preheated prior to performing the resin supplying step, fluidity of the liquid resin can be improved so that the liquid resin introduced into the coil part accommodating cell flows smoothly from the resin supplying cell via the communicating part.

Preferably, the coil part has a flat surface, and the coil part accommodating cell has a flat inner bottom surface, and the method further includes a pressing step for pressing the coil part against the coil part accommodating cell so that the flat surface of the coil part maintains surface contact with the inner bottom surface of the coil part accommodating cell during a period at least after completing the introducing step and until completing the hardening step.

By providing the coil part with a flat surface and forming the inner bottom surface of the coil part accommodating cell in a flat shape and by pressing the coil part into the coil part accommodating cell so that the flat surface of the coil part contacts the inner bottom surface of the coil part accommodating cell at least after completing the introducing step and until completing the hardening step, it is possible to place the flat surface of the coil part firmly in contact with the bottom surface to prevent the liquid resin from flowing around the flat surface of the coil part, thereby preventing the liquid resin from becoming deposited on the surface of the coil part.

Preferably, the coil part includes a winding portion about which a winding is wound, and a pair of flanges disposed one on either end of the winding portion and extending in a direction orthogonal to an axis of the winding portion, and the coil part is supported at least in the resin supplying step so that at least part of the winding portion in the coil part accommodated in the coil part accommodating cell opposes an opening in the communicating part communicating with the coil part accommodating cell.

The coil part has a winding portion about which a winding is wound, and a pair of flanges disposed one on either end of the winding portion and extending in a direction orthogonal to the axis of the winding portion. Since the coil part is supported at least in the resin supplying cell so that at least part of the winding portion of the coil part accommodated in the coil part accommodating cell opposes the opening in the communicating part that communicates with the coil part accommodating cell, the liquid resin can be smoothly supplied through the communicating part to the winding portion about which the winding is wound.

In still another aspect of the invention, there is provided an apparatus for manufacturing coil components including a resin supplying cell, a coil part accommodating cell, a communication part, a resin supplying unit, and a hardening unit. The resin supplying cell is capable of storing a liquid resin. The coil part accommodating cell is capable of accommodating at least a part of a coil part constituting the coil component. The communicating part provides communication between the resin supplying cell and the coil part accommodating cell. The resin supplying unit supplies the liquid resin to the resin supplying cell. The hardening unit solidifies the liquid resin that has flowed into the coil part accommodating cell from the resin supplying cell via the communicating part.

With this apparatus having a resin supplying cell capable of storing liquid resin, a coil part accommodating cell capable of accommodating at least a portion of the coil part, and a communicating part providing communication between the resin supplying cell and the coil part accommodating cell, a coil component having a resin part can be manufactured by supplying liquid resin to the resin supplying cell in order to cover a desired portion of a coil part accommodated in the coil part accommodating cell with liquid resin. Since a sufficient amount of liquid resin is deposited to fill the desired area of the coil part, a coil component having sufficient resin in the desired area of the coil part can be manufactured according to simple steps, without performing such complex steps as supplying the liquid resin to the desired area a plurality of times. This apparatus also enhances the properties of the coil components are reduces variation in properties among individual components, while protecting the desired area.

Further, by supplying an appropriate amount of liquid resin to the resin supplying cell, it is possible to prevent the liquid resin from overflowing from the coil part accommodating cell, thereby preventing liquid resin from becoming deposited on areas of the coil part other than the desired area. Further, since the liquid resin flows from the resin supplying cell into the coil part accommodating cell via the communicating part, the liquid resin can gradually cover the desired area of the coil part, minimizing the amount of air bubbles that may be contained in the resin covering the coil part.

Preferably a liquid level controlling unit is provided that maintains a level of the liquid resin at a prescribed position when the liquid resin has accumulated in the resin supplying cell, communicating part, and coil part accommodating cell as a result of supplying the liquid resin into the resin supplying cell so that liquid resin flows into the coil part accommodating cell via the communicating part.

By providing the apparatus with liquid level controlling unit for maintaining the level of liquid resin at a prescribed position while liquid resin has accumulated in the resin supplying cell, communicating part, and coil part accommodating cell, resin can be provided to the prescribed area of the coil part with great accuracy.

Preferably, the liquid level controlling unit is configured to maintain the level of liquid resin in the resin supplying cell at the prescribed position.

By providing liquid level controlling unit in the resin supplying cell, it is possible to maintain the level of liquid resin in the resin supplying cell at a prescribed position. If the resin supplying cell and the coil part accommodating cell are left open to the atmosphere, the level of resin in the resin supplying cell can be matched to the level of resin in the coil part accommodating cell, thereby maintaining the level of liquid resin in the coil part accommodating cell at a prescribed position so that resin is supplied to the desired position on the coil part. Therefore, in situations where managing the level of liquid resin in the coil part accommodating cell is difficult, the level of fluid in the coil part accommodating cell can be managed indirectly by managing the level of fluid in the resin supplying cell.

Preferably, the liquid level controlling unit is configured to maintain the level of liquid resin in the coil part accommodating cell at the prescribed position.

By providing the liquid level controlling unit in the coil part accommodating cell, the level of liquid resin in the coil part accommodating cell can be maintained directly at the prescribed position. Since the level of resin in the coil part accommodating cell can be managed directly with great precision, resin can be provided to the desired position on the coil part with greater accuracy.

Preferably, the resin supplying cell, the coil part accommodating cell, and the communicating part are recessed parts formed in a surface of a die comprising a deformable, elastic member.

Since the resin supplying cell, coil part accommodating cell, and communicating part are configured of recesses formed in the surface of the deformable, elastic die, a coil component with hardened resin can be extracted from the coil part accommodating cell by deforming the die, thereby facilitating extraction of the coil component.

Preferably, a preheating unit is provided that is configured to preheat at least the resin supplying cell, the coil part accommodating cell, the communicating part, and the coil part. The preheating unit can preheat the resin supplying cell, coil part accommodating cell, communicating part, and coil part prior to supplying liquid resin to the resin supplying cell. Accordingly, fluidity of the liquid resin can be improved when supplying the liquid resin to the preheated resin supplying cell so that the liquid resin introduced into the coil part accommodating cell flows smoothly from the resin supplying cell via the communicating part.

Preferably, the coil part has a flat surface, and the coil part accommodating cell has a flat inner bottom surface, and the apparatus further includes a pressing device for pressing the coil part in the coil part accommodating cell so that the flat surface of the coil part is in surface contact with the inner bottom surface of the coil part accommodating cell.

The pressing device can press the coil part in the coil part accommodating cell so that the flat surface of the coil part firmly contacts the inner bottom surface of the coil part accommodating cell. Accordingly, it is possible to prevent liquid resin from flowing around the flat surface of the coil part, thereby preventing resin from becoming deposited on this surface.

Preferably, the coil part includes a winding portion about which a winding is wound, and a pair of flanges disposed one on either end of the winding portion and extending in a direction orthogonal to an axis of the winding portion, and the communicating part has an opening in communication with the coil part accommodating cell, at least a part of the winding portion of the coil part accommodated in the coil part accommodating cell being in confrontation with the opening.

The coil part includes the winding portion about which a winding is wound, and a pair of flanges disposed one on either end of the winding portion and extending in a direction orthogonal to the axis of the winding portion. Since the opening in the communicating part communicating with the coil part accommodating cell opposes at least part of the winding portion of the coil part accommodated in the coil part accommodating cell, liquid resin can be smoothly supplied through the communicating part to the winding portion about which the winding is wound.

DETAILED DESCRIPTION

Figure 1:
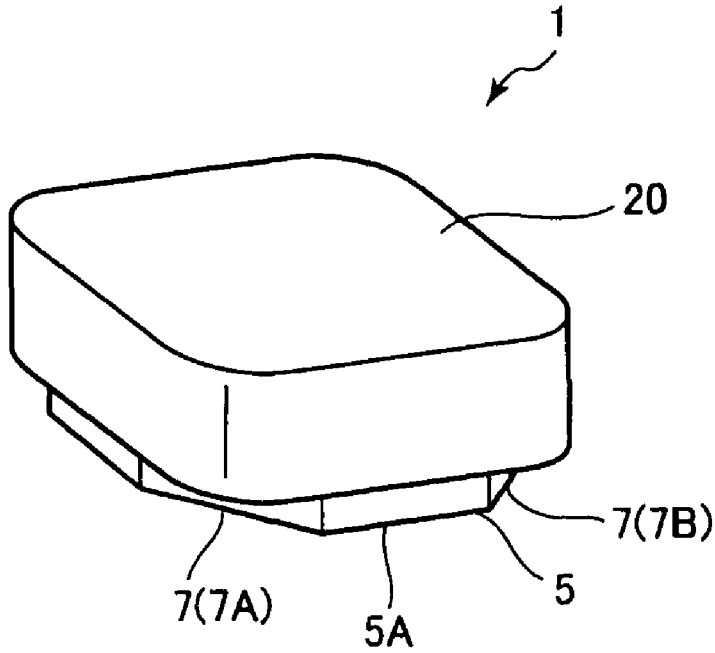
FIG. 1 is a top perspective view showing a coil component according to one embodiment of the present invention.
Figure 2:
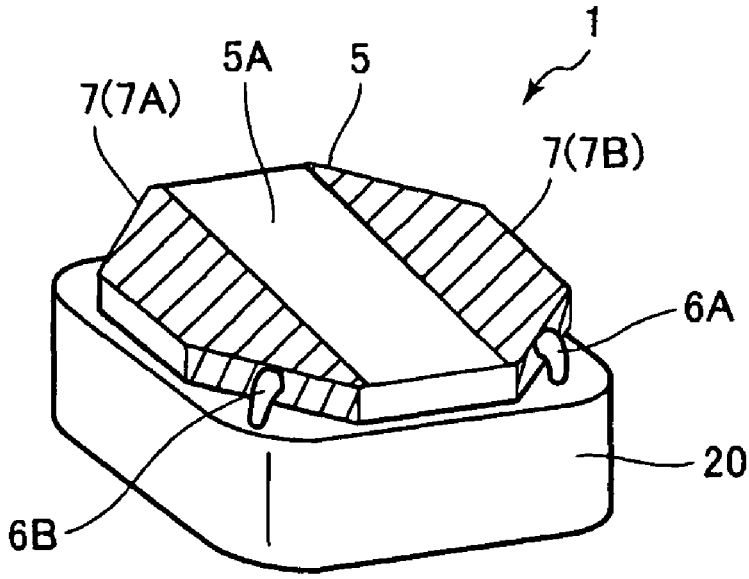
FIG. 2 is a bottom perspective view showing the coil component according to the embodiment.
Figure 3:
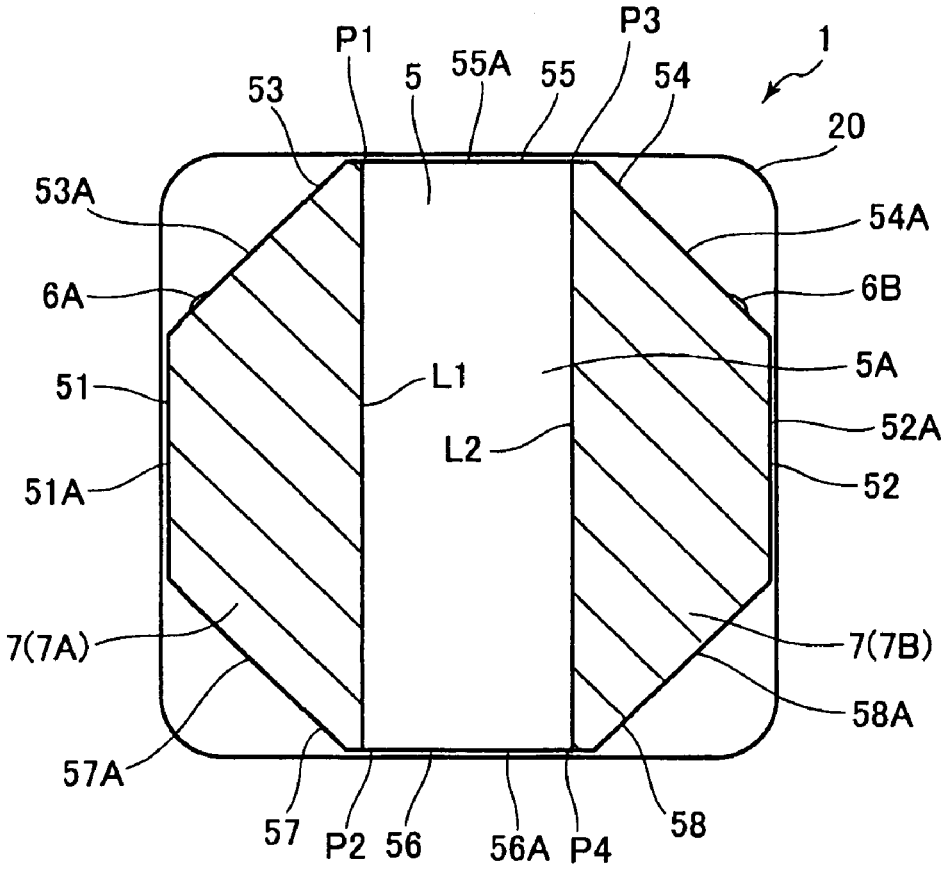
FIG. 3 is a bottom view of the coil component according to the embodiment.
Figure 4:
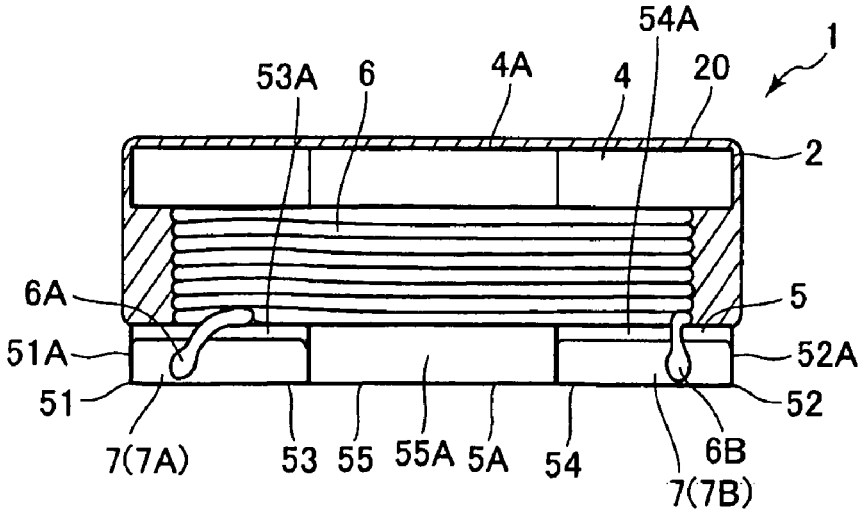
FIG. 4 is a cross-sectional view showing the coil component according to the embodiment.

A coil component and method and apparatus for manufacturing the same according to one embodiment of the present invention will be described with reference to FIGS. 1 through 8. First the coil component itself will be described. A coil component 1 is specifically a coil component for a power supply system. As shown in FIG. 4, the coil component 1 is primarily configured of a core 2, a single winding 6, terminal electrodes 7, and a resin part 20. The portion of the coil component 1 excluding the resin part 20 corresponds to a coil part.

The core 2 has a base magnetic material such as ferrite and includes a substantially cylindrical winding portion 3 (see FIG. 7), and a first flange 5 and a second flange 4 disposed one on either end of the winding portion 3. Since the first and second flanges 5 and 4 are shaped symmetrically to each other, only the first flange 5 will be described below.

The first flange 5 is substantially plate-shaped with a prescribed thickness. The first flange 5 has a bottom surface 5A that is substantially octagonal in shape, all sides being equivalent in length. As shown in FIG. 3, the bottom surface 5A includes a first side 51, a second side 52, a first omitted side 53, a second omitted side 54, a third side 55, a fourth side 56, a third omitted side 57, and a fourth omitted side 58.

The first and second sides 51 and 52 are parallel sides, the first and second omitted sides 53 and 54 are disposed on one side of the first and second sides 51 and 52, and the third and fourth omitted sides 57 and 58 are disposed on the other side of the first and second sides 51 and 52. The third side 55 is provided between the first and second omitted sides 53 and 54, and the fourth side 56 is provided between the third and fourth omitted sides 57 and 58. The third and fourth sides 55 and 56 are substantially parallel. These sides 51 to 58 constitute the peripheral edge of the bottom surface 5A.

When the coil component 1 is mounted on a circuit board, the first, second, third, and fourth sides 51, 52, 55, and 56 are substantially in contact with or in close proximity to the electronic parts of other neighboring coil components.

When viewing the bottom surface 5A from the bottom along a line connecting the first and second flanges 5 and 4, as shown in FIG. 3, the first, second, third, and fourth omitted sides 53, 54, 57, and 58 form the chamfered four corners of an imaginary square constructed by extending each of the first, second, third, and fourth sides 51, 52, 55, and 56. This construction inhibits the first, second, third, and fourth omitted sides 53, 54, 57, and 58 from substantially coming into contact with other electronic parts. The bottom surface 5A forms one endface of the core 2 and serves as a-mounting surface by which the coil component 1 is mounted on a circuit board (not shown).

The resin part 20 described later is provided to fill in the chamfered four corners described above to form the four corners of the imaginary square. Hence, when viewing the bottom surface 5A from the bottom along a line connecting the first and second flanges 5 and 4, as shown in FIG. 3, the resin part 20 forms a substantially square-shaped outline.

As shown in FIG. 4, a top surface 4A is defined on the second flange 4 as the other endface of the core 2. The first flange 5 has a first peripheral surface 51A, a second peripheral surface 52A, a first omitted peripheral surface 53A, a second omitted peripheral surface 54A, a third peripheral surface 55A, a fourth peripheral surface 56A (see FIG. 3), a third omitted peripheral surface 57A (see FIG. 3), and a fourth omitted peripheral surface 58A (see FIG. 3) as the peripheral surface of the first flange 5 extending from the bottom surface 5A toward the top surface 4A. The peripheral surfaces 51A-58A extend from the corresponding sides 51-58.

Figure 7:
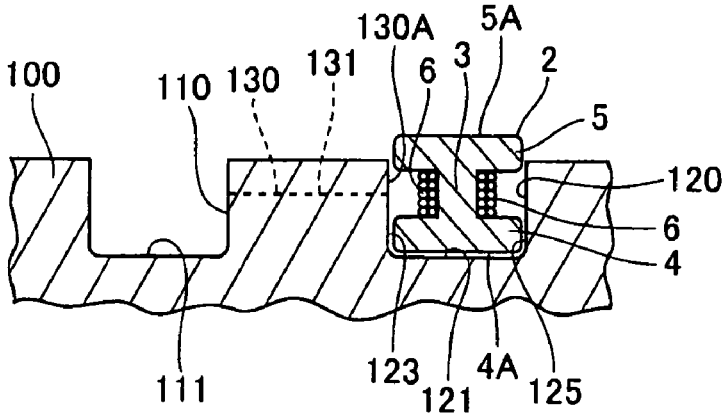
FIG. 7 is a schematic side view illustrating an introducing step in a method of manufacturing the coil component according to the embodiment.

The winding 6 is a copper wire having an insulating coating and is wound about the winding portion 3 (see FIG. 7). The winding 6 has a first end 6A and a second end 6B electrically connected to the terminal electrodes 7.

The terminal electrodes 7 include a first terminal electrode 7A and a second terminal electrode 7B. As shown in FIGS. 3 and 4, the first terminal electrode 7A is provided across a portion of the first omitted peripheral surface 53A, a portion of the bottom surface 5A, and a portion of the third omitted peripheral surface 57A. As shown in FIGS. 2 and 3, the first terminal electrode 7A covers a region on the bottom surface 5A at least linking the entire length of the first omitted side 53 to the entire length of the third omitted side 57, and preferably a region extending to a first borderline L1 linking a point P1 on the third side 55 to a point P2 on the fourth side 56.

The second terminal electrode 7B is provided across a portion of the second omitted peripheral surface 54A, a portion of the bottom surface 5A spaced away from the first terminal electrode 7A, and a portion of the fourth omitted peripheral surface 58A. As shown in FIGS. 2 and 3, the second terminal electrode 7B occupies a region on the bottom surface 5A at least extending to a region connecting the entire length of the second omitted side 54 to the entire length of the fourth omitted side 58, and preferably a region extending to a second borderline L2 linking a point P3 on the third side 55 spaced away from the point P1 to a point P4 on the fourth side 56 spaced away from the point P2. It should be apparent that points P1-P4 are positioned so that the first and second terminal electrodes 7A and 7B are separated from each other on the bottom surface 5A. By forming the first and second terminal electrodes 7A and 7B in regions on the bottom surface 5A as described above, it is possible to obtain maximum connection area between the electrodes and a land pattern on the circuit board, thereby improving the bond between the electrodes and land pattern when mounting the coil component 1 on the circuit board. Further, by increasing the surface area at which the electrodes oppose the land pattern of the circuit board, this configuration enhances self-alignment of the coil components 1 during reflow soldering. More specifically, to mount the coil components 1 on a circuit board, solder paste is applied to the land pattern for mounting the coil components, after which reflow soldering is performed to electrically connect the coil components to the circuit board. By providing electrodes with a large surface area on the bottom of the coil component 1, it is possible to maintain the integrity of the connections between the electrodes and the land pattern during this reflow process while the solder paste is re-melted, enabling the coil components to settle down onto the land pattern.

Since the first flange 5 has an octagonal shape and connections are formed on the first and second omitted peripheral surfaces provided on the outer periphery of the first flange 5, a minimum mounting area can be ensured while forming solder fillets between the first flange 5 and the circuit board (not shown) when arranging coil components 1 having the above construction on a circuit board, enabling the coil components 1 to be mounted at a high density. That is, a plurality of coil components 1 is mounted with the first peripheral surface 51A of one coil component 1 adjacent to the second peripheral surface 52A of another coil component 1, and the third peripheral surface 55A of one coil component 1 adjacent to the fourth peripheral surface 56A of still another coil component 1. At this time, the first omitted peripheral surface 53A of one coil component 1 is also positioned adjacent to the second omitted peripheral surface 54A of another coil component 1. However, since the first and second omitted peripheral surfaces 53A and 54A have been chamfered at the first and second peripheral surfaces 51A and 52A, there is little risk of short-circuiting caused by the first and second terminal electrodes 7A and 7B formed on the first and second omitted peripheral surfaces 53A and 54A from coming into direct contact or contact through a solder fillet. Similarly, the first omitted peripheral surface 53A of one coil component 1 is positioned adjacent to the third omitted peripheral surface 57A of still another coil component 1, but these surfaces have also been chamfered to reduce the risk of short-circuiting caused by contact between the first and second terminal electrodes 7A and 7B. Accordingly, the coil components 1 can be mounted densely on the circuit board.

Further, since the ends of the winding 6 are electrically connected to the terminal electrodes 7 at the first and second omitted sides 53 and 54 constituting the outer periphery of the core 2, as shown in FIG. 4, no part of the winding 6 runs along the bottom surface 5A by which the coil component 1 is mounted. Therefore, the height of the coil component 1 is defined merely by the distance from the bottom surface 5A forming one endface of the core 2 to the top surface 4A forming the other endface, enabling the coil component 1 to be formed at a low height. Further, by connecting ends of the winding 6 at the first and second omitted peripheral surfaces 53A and 54A, the connected parts can easily be seen after the coil component 1 is mounted on the circuit board (not shown). Thus, this construction facilitates external inspection of fillets and the like after the coil component 1 is mounted.

As shown in FIG. 4 and the like, the first end 6A of the winding 6 is connected to the first terminal electrode 7A at part of the first omitted peripheral surface 53A, and the second end 6B of the winding 6 is connected to the second terminal electrode 7B at part of the second omitted peripheral surface 54A. These connections are made through diffusion bonding. Examples of diffusion bonding include thermo-compression bonding, welding such as laser welding and resistance welding, and ultrasonic bonding. In other words, the connections are formed by diffusion bonding rather than soldering. If the wires were connected by soldering, the solder could conceivably melt from the heat generated during the reflow process, allowing the wires to become disconnected from the electrodes. However, connections formed by diffusion bonding do not melt from the heat of reflow, and thus the wire connections can be maintained.

Further, since the ends of the winding are electrically connected to parts on the peripheral surface on the first flange 5, no part of the winding 6 runs over the bottom surface 5A by which the coil component 1 is mounted. Therefore, the height of the coil component 1 is defined merely by the distance from one endface of the core to the other endface, enabling the coil component 1 to be formed at a low height. In other words, when the winding is not connected to the bottom surface of the first flange 5, the height of the coil component 1 can be reduced by an amount equivalent to the diameter of the winding. Put another way, the volume of the core can be increased by an amount equivalent to the height of a single winding.

As shown in FIG. 4 and the like, the resin part 20 is provided around the core 2 so as to cover the second flange 4, the winding portion 3 about which the winding 6 is wound (see FIG. 7), and part of the first flange 5 of the core 2. The resin part 20 is formed of a thermo-setting resin containing magnetic powder. Specifically, the resin part 20 is primarily made from an epoxy resin hardened material and a ferrite and is hardened upon application of heat, as will be described later. By adjusting the mixture ratio of ferrite powder to resin, the properties of the coil component can be freely set as required. As shown in FIG. 4, the resin part 20 covers the winding portion 3 about which the winding 6 is wound so as to fill in the gap between the first and second flanges 5 and 4. The resin part 20 also covers the entire second flange 4 and a portion of the first flange 5. Hence, the winding and nearly the entire drum core can be protected by a layer of resin. Further, as shown in FIG. 3, the resin part 20 is formed with a substantially square outline.

More specifically, by imagining the first, second, third, and fourth omitted sides 53, 54, 57, and 58 as four chamfered corners of an imaginary square shape constructed by extending the first, second, third, and fourth sides 51, 52, 55, and 56 of the core 2, the resin part 20 forms a substantially square shape in a bottom view by filling in these four chamfered corner portions. As shown in FIG. 4, the entire bottom surface 5A of the first flange 5, as well as most of the first peripheral surface 51A, second peripheral surface 52A, first omitted peripheral surface 53A, second omitted peripheral surface 54A, third peripheral surface 55A, fourth peripheral surface 56A (see FIG. 3), third omitted peripheral surface 57A, and fourth omitted peripheral surface 58A connected to the bottom surface 5A are not covered by the resin part 20 but are exposed therefrom.

Since the resin part 20 has a substantially square outline in a bottom view, the coil component 1 can be accommodated in the cavity of a carrier tape having a plurality of cavities each having a substantially square shape in a plan view so that the coil component 1 can be oriented in a predetermined direction linking the first and second terminal electrodes 7A and 7B, thereby preventing the coil component 1 from rotating within the cavity during transport. In this way, the carrier tape can be used to maintain the coil component 1 in a fixed orientation during transport. Further, since the first and second flanges 5 and 4 of the core 2 are octagonal in shape, the core 2 can be formed with the first flange 5, second flange 4, and winding portion 3 by machining a base material made from ferrite or another magnetic material while rotating the core 2 about a rotational axis corresponding to a central axis of the winding portion 3.

Further, since the resin part 20 protrudes outside of the outlines of the first and second flanges 5 and 4 in a bottom view, a resultant coil component 1 can provide excellent characteristic such as suitable L (inductance) value, while protecting the winding portion 3 of the core 2 about which the winding 6 is wound.

Figure 5:
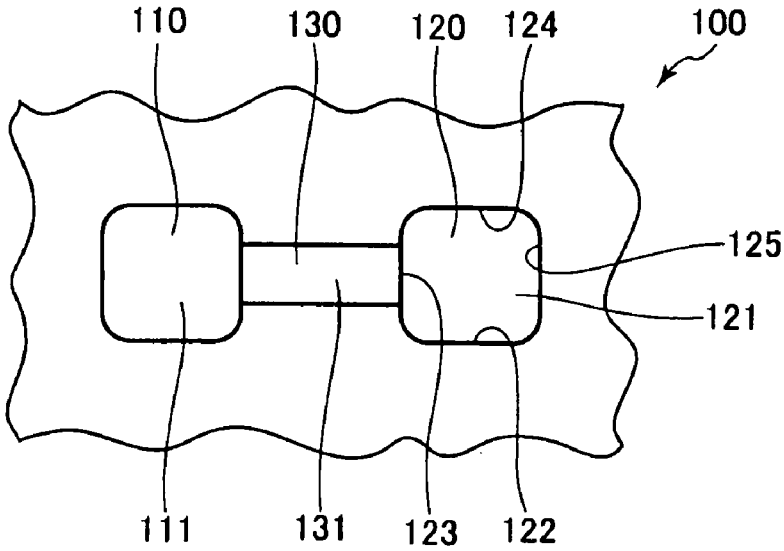
FIG. 5 is a plan view of a die in an apparatus for manufacturing the coil component according to the embodiment.
Figure 6:
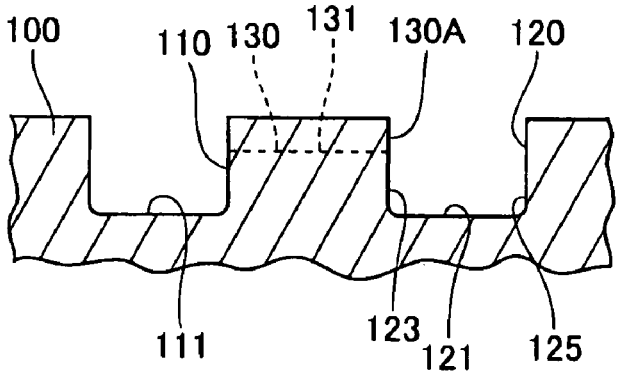
FIG. 6 is a schematic side view showing part of the die in the apparatus for manufacturing the coil component according to the embodiment.

Next, an apparatus for manufacturing the coil component 1 having the above construction will be described. As shown in FIG. 5, the apparatus for manufacturing coil components includes a die 100 formed of a deformable, elastic silicone member. In the surface of the die 100 are formed a resin supplying cavity 110 having a substantially rectangular shape, a coil part accommodating cavity 120 also substantially rectangular in shape, and a communicating channel 130 connecting the resin supplying cavity 110 and coil part accommodating cavity 120. Each of the resin supplying cavity 110, coil part accommodating cavity 120, and communicating channel 130 is open to the atmosphere. The die 100 is configured so that the fluid level of a liquid resin 20' (FIG. 8) that has flowed into the coil part accommodating cavity 120 from the resin supplying cavity 110 via the communicating channel 130, as will be described later, matches the level of the liquid resin 20' in the resin supplying cavity 110. Here, the portion of the die 100 constituting a resin supplying cavity 110 corresponds to a resin supplying cell, the portion of the die 100 constituting the coil part accommodating cavity 120 corresponds to a coil part accommodating cell, and the portion of the die 100 constituting the communicating channel 130 corresponds to a communicating part. Since the die 100 is made from a deformable, elastic silicone member, the coil component 1 having a resin part 20 can be extracted from the coil part accommodating cavity 120 by deforming the die 100 after the resin part 20 has solidified, thereby facilitating extraction of the coil component 1.

The liquid resin 20', which will be hardened to form the resin part 20 in a hardening step described later, is supplied to and temporarily stored in the resin supplying cavity 110. The resin supplying cavity 110 has a substantially rectangular parallelepiped shape and has a flat bottom surface 111 with the same depth as a bottom surface 121 in the coil part accommodating cavity 120 described later. When the resin part 20 is not provided on the coil portion, the coil part accommodating cavity 120 can accommodate the entire winding portion 3 and second flange 4 and part of the first flange 5 of the core 2. The coil part accommodating cavity 120 has a substantially rectangular parallelepiped shape and is defined by a first side surface 122, a second side surface 123, a third side surface 124, a fourth side surface 125, and the bottom surface 121, all of which are flat surfaces. As shown in FIG. 5, the coil part accommodating cavity 120 is substantially square shaped in a plan view and has the same dimensions as the square outline part of the coil part shown in the bottom view of FIG. 3.

The communicating channel 130 is a substantially elongated rectangular parallelepiped and has a level bottom surface 131. As shown in FIG. 7, the bottom surface 131 is positioned slightly higher than the junction between the second flange 4 and winding portion 3 of the core 2 when the core 2 is accommodated in the coil part accommodating cavity 120. Hence, an opening 130A of the communicating channel 130 allowing communication between the communicating channel 130 and coil part accommodating cavity 120 is positioned in opposition to the winding portion 3 of the core 2. Put another way, the core 2 is supported so that the winding portion 3 of the core 2 opposes the opening 130A of the communicating channel 130 communicating with the coil part accommodating cavity 120. With this construction, the liquidized resin 20' can be smoothly supplied through the communicating channel 130 to the winding portion 3 about which the winding 6 is wound.

As shown in FIGS. 10 through 13, an apparatus for manufacturing coil components includes a resin supplying device 200, a hardening device 210, a liquid level controlling device 220, and a preheating device 230. The resin supplying device 200 is connected to a resin cell 201 and is adapted for supplying liquid resin 20' to the resin supplying cavity 110.

The hardening device 210 includes a dryer 211 accommodating the die 100 to which the liquid resin 20' is supplied, and an air blower 212 for supplying hot air into the dryer 211. The hardening device 210 heats the liquid resin 20' supplied to the coil part accommodating cavity 120 from the resin supplying cavity 110 via the communicating channel 130, the liquid resin 20' within the communicating channel 130, and the liquid resin 20' within the resin supplying cavity 110 and for hardening the liquid resin 20' within each of the coil part accommodating cavity 120, communicating channel 130, and resin supplying cavity 110.

The preheating device 230 is adapted to preheat the die 100 and the coil part to 40-80° C. prior to the resin supplying step described later. The preheating device 230 includes a dryer 231 and an air blower 232 supplying hot air into the dryer 231.

Figure 11:
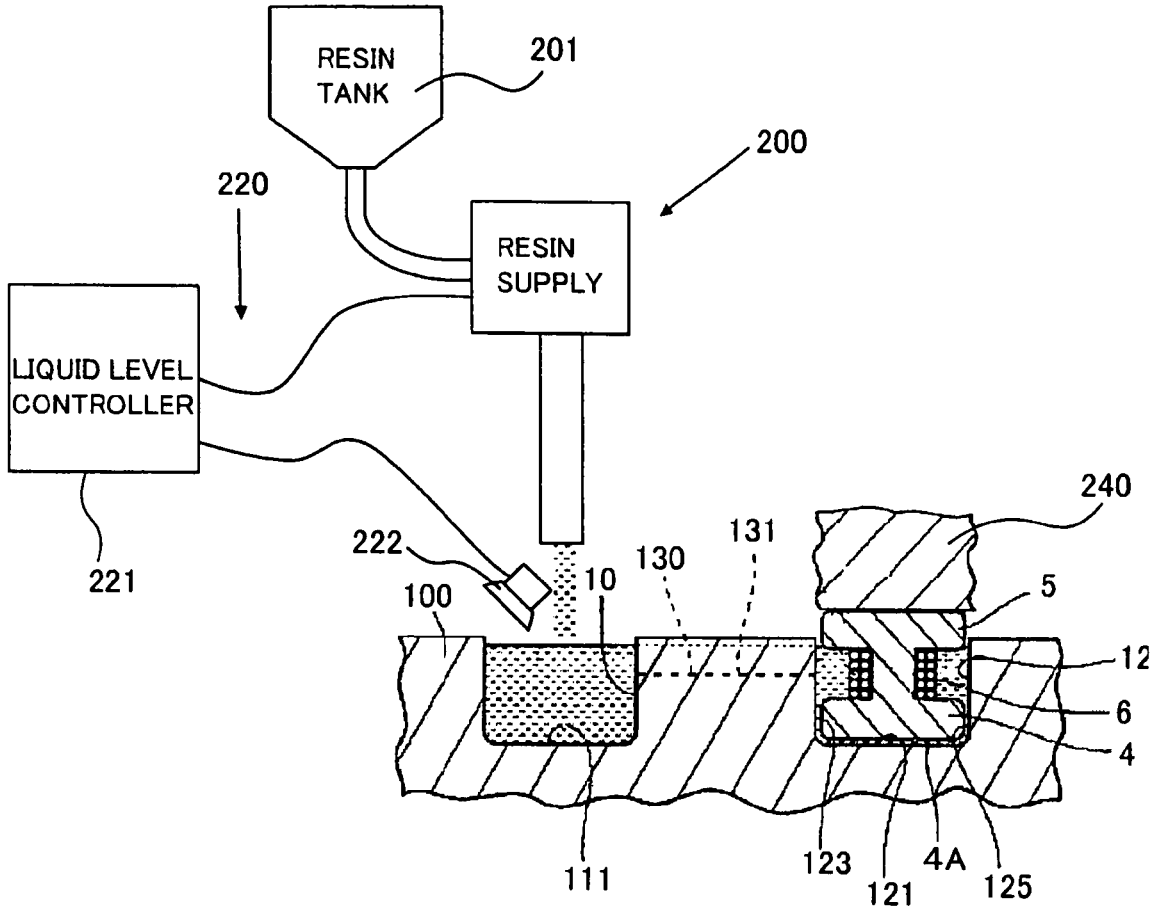
FIG. 11 is a schematic diagram illustrating the resin supplying step in the method of manufacturing the coil component according to the embodiment.
Figure 12:
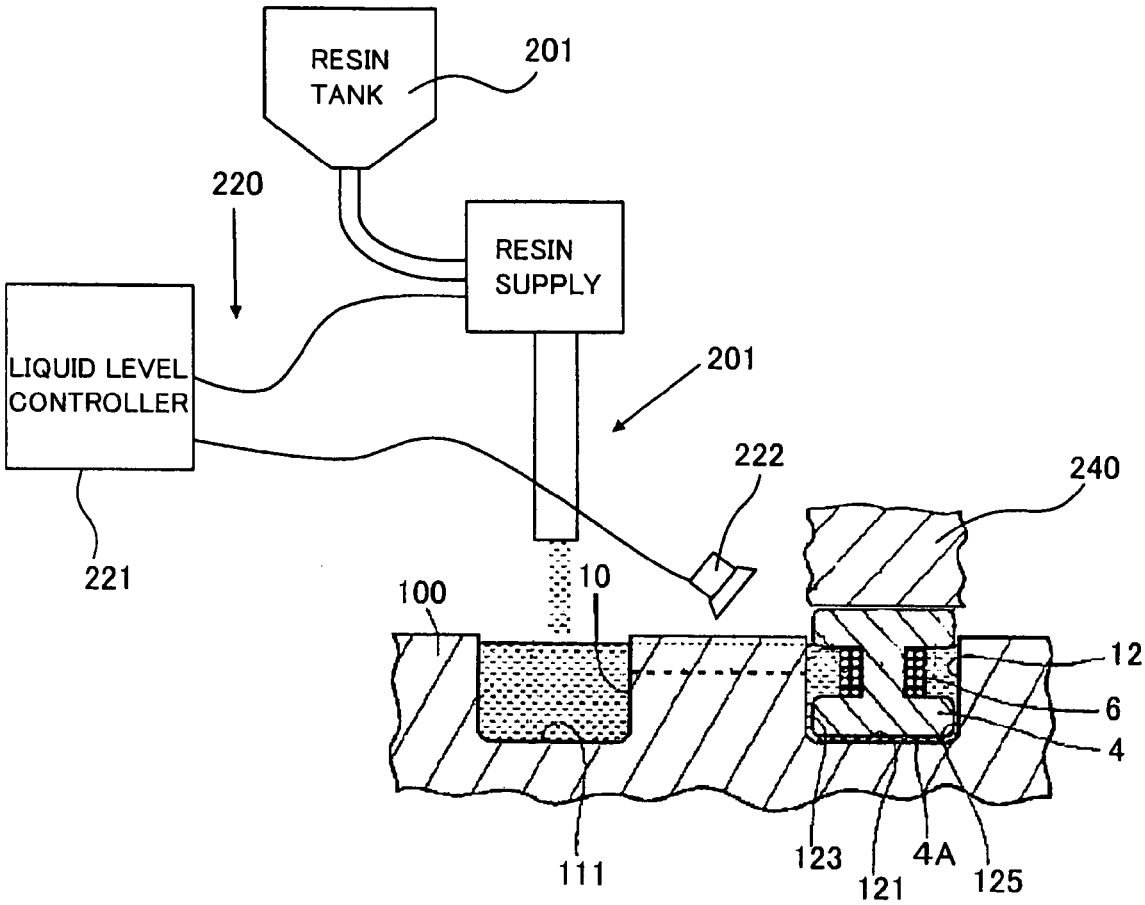
FIG. 12 is a schematic diagram illustrating a liquid level controlling step for a resin supplying cell in the method of manufacturing the coil component according to the embodiment.

The liquid level controlling device 220 is configured to maintain the liquid resin 20' in the resin supplying cavity 110 at a prescribed level by adjusting the amount of the liquid resin 20' that the resin supplying device 200 supplies into the resin supplying cavity 110. As shown in FIGS. 11 and 12, the liquid level controlling device 220 includes a liquid level controller 221 and a monitor 222. The preheating device 230 corresponds to preheating unit, while the liquid level controlling device 220 constitutes the liquid level controlling unit.

In the method of manufacturing the coil component, first a core 2 for the coil part is prepared, and the winding 6 is wound about the winding portion 3 of the core 2 to configure the coil part. Next, a die preparation step is performed to prepare the silicone die 100 with the resin supplying cavity 110, coil part accommodating cavity 120, and communicating channel 130 formed in the surface thereof.

Next, an introducing step is performed. In the introducing step, as shown in FIG. 7, the core 2 of the coil part is inserted into the coil part accommodating cavity 120 so that the second flange 4 is on the bottom with the surface 4A of the second flange 4 opposing the bottom surface 121 and the axis of the winding portion 3 oriented vertically. At this time, the second flange 4, the winding portion 3, and the first flange 5 portion connected to the winding portion 3 are accommodated within the coil part accommodating cavity 120.

Figure 10:
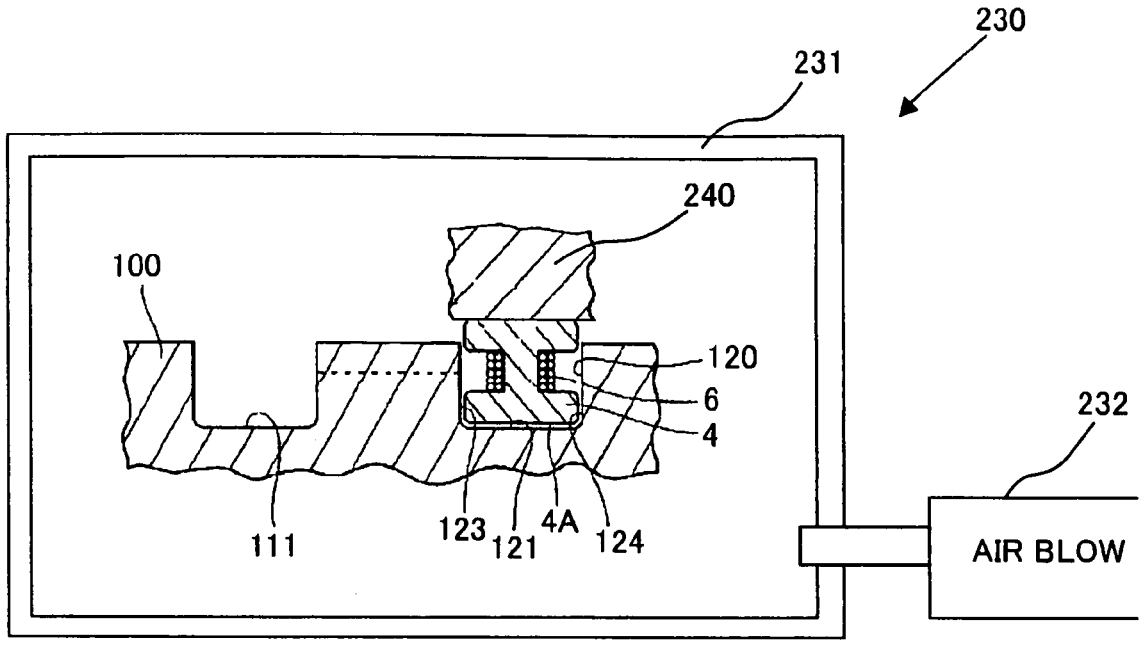
FIG. 10 is a schematic diagram illustrating a preheating step in the method of manufacturing the coil component according to the embodiment.

Next, the preheating step shown in FIG. 10 is performed. In the preheating step, the preheating device 230 is used to heat the core 2 and the die 100 to a temperature of 40-80° C. in order that the liquid resin 20' reaches an optimal viscosity for flowing into the coil part accommodating cavity 120 at an optimal flow rate. While maintaining the core 2 and die 100 at this temperature, the resin supplying step shown in FIG. 11 is performed. In the resin supplying step, the resin supplying device 200 supplies liquid resin 20' into the resin supplying cavity 110. As the resin supplying device 200 continuously supplies the liquid resin 20', the level of the liquid resin 20' in the resin supplying cavity 110 rises. When the level of the liquid resin 20' exceeds the height of the bottom surface 131 of the communicating channel 130, the liquid resin 20' flows into the communicating channel 130, passes through the communicating channel 130, and flows into the coil part accommodating cavity 120.

By adjusting the amount of liquid resin 20' that the resin supplying device 200 supplies into the resin supplying cavity 110, it is possible to keep the flow rate of liquid resin 20' into the coil part accommodating cavity 120 from becoming too high. This process ensures that the liquid resin 20' flows into the area between the second flange 4 and first flange 5 where the winding 6 is wound about the winding portion 3 at a suitable flow rate to gradually eliminate air contained in this area, thus minimizing the amount of air bubbles contained in the resin part 20 of the coil component 1.

Figure 8:
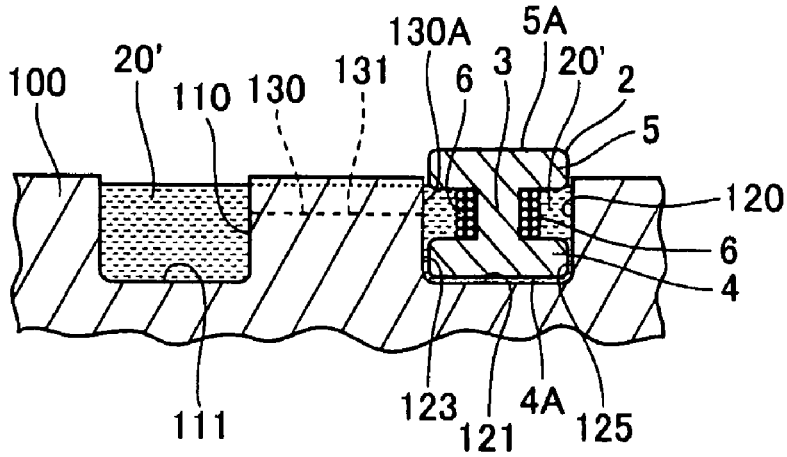
FIG. 8 is a schematic side view illustrating a resin supplying step in the method of manufacturing the coil component according to the embodiment.

The liquid level controlling device 220 controls the supply rate of liquid resin 20', as shown in FIG. 12, so that liquid resin 20' in the resin supplying cavity 110 is at a prescribed level, as shown in FIG. 8. Since the liquid resin 20' in the coil part accommodating cavity 120 is at the same level as the liquid resin 20' in the resin supplying cavity 110, the level of the liquid resin 20' in the coil part accommodating cavity 120 can be controlled by controlling the level of the liquid resin 20' in the resin supplying cavity 110. Hence, it is possible to control the portion of the core 2 immersed in liquid resin 20' in the coil part accommodating cavity 120 by maintaining the level of the liquid resin 20' in the resin supplying cavity 110 at a prescribed position. Therefore, in situations where managing the level of liquid resin 20' in the coil part accommodating cavity 120 is difficult, the level of fluid in the coil part accommodating cavity 120 can be managed indirectly by managing the level of fluid in the resin supplying cavity 110.

Figure 13:
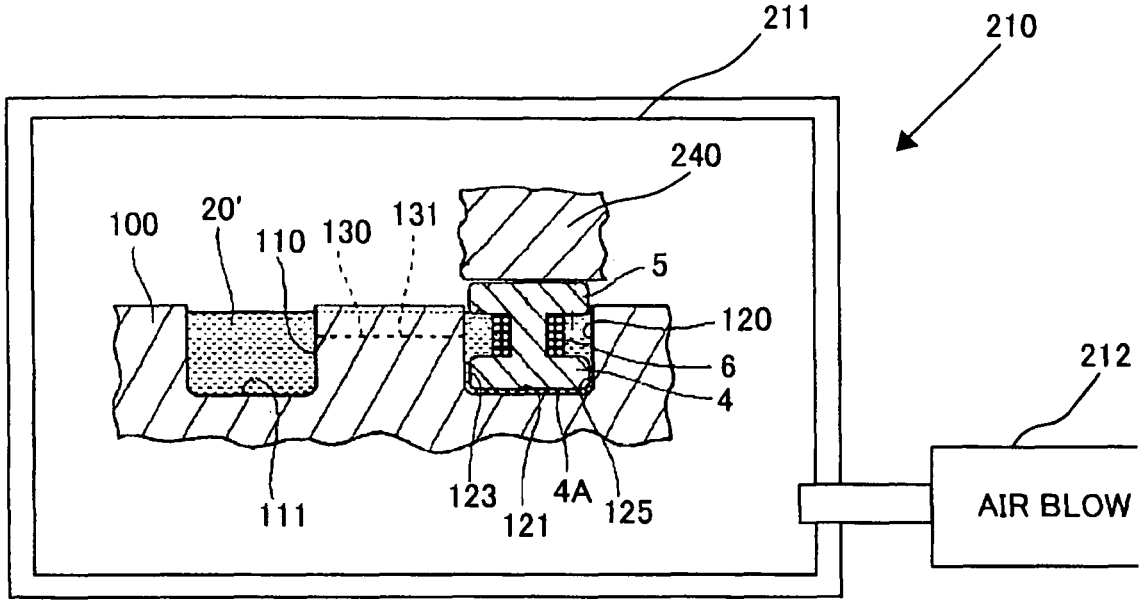
FIG. 13 is a schematic diagram illustrating a hardening step in the method of manufacturing the coil component according to the embodiment.

Next, the hardening step shown in FIG. 13 is performed. In the hardening step, the hardening device 210 heats the liquid resin 20' that has flowed into the coil part accommodating cavity 120, the liquid resin 20' in the communicating channel 130, and the liquid resin 20' in the resin supplying cavity 110 to 1500C to harden the liquid resin 20' in the coil part accommodating cavity 120, communicating channel 130, and resin supplying cavity 110. Next, the die 100 is deformed to extract the coil component 1 having the solidified resin part 20 from the coil part accommodating cavity 120 of the die 100, and manufacturing of the coil component 1 is completed by cutting off excess resin.

By performing the introducing step and the resin supplying step described above, it is possible to supply sufficient liquid resin 20' to the region of the winding portion 3 between the second flange 4 and first flange 5, even when the length of the winding portion 3 in the axial direction is relatively long, thereby enhancing the properties of the coil component 1 while protecting the winding portion 3. Since a sufficient amount of liquid resin 20' can be supplied to the region of the winding portion 3 between the first and second flanges 5 and 4, the coil component 1 can be manufactured according to simple steps, without performing such complex steps as supplying the liquid resin 20' a plurality of times.

By using the resin supplying device 200 to supply an appropriate amount of liquid resin 20' in the resin supplying step so that the level of liquid resin 20' in the resin supplying cavity 110 is maintained at a prescribed position, it is possible to prevent the liquid resin 20' from overflowing from the coil part accommodating cavity 120, thereby preventing liquid resin 20' from becoming deposited on the terminal electrodes 7 of the first flange 5. Further, since the liquid resin 20' flows from the resin supplying cavity 110 into the coil part accommodating cavity 120 via the communicating channel 130, the liquid resin 20' can gradually cover the winding portion 3 portion of the core 2, minimizing the amount of air bubbles that are contained in the resin part 20 covering the winding portion 3.

Further, since the die 100 and the core 2 are preheated with the preheating device 230 in the preheating step, fluidity of the liquid resin 20' can be improved so that the liquid resin 20' introduced into the coil part accommodating cavity 120 flows smoothly from the resin supplying cavity 110 via the communicating channel 130.

Figure 9:
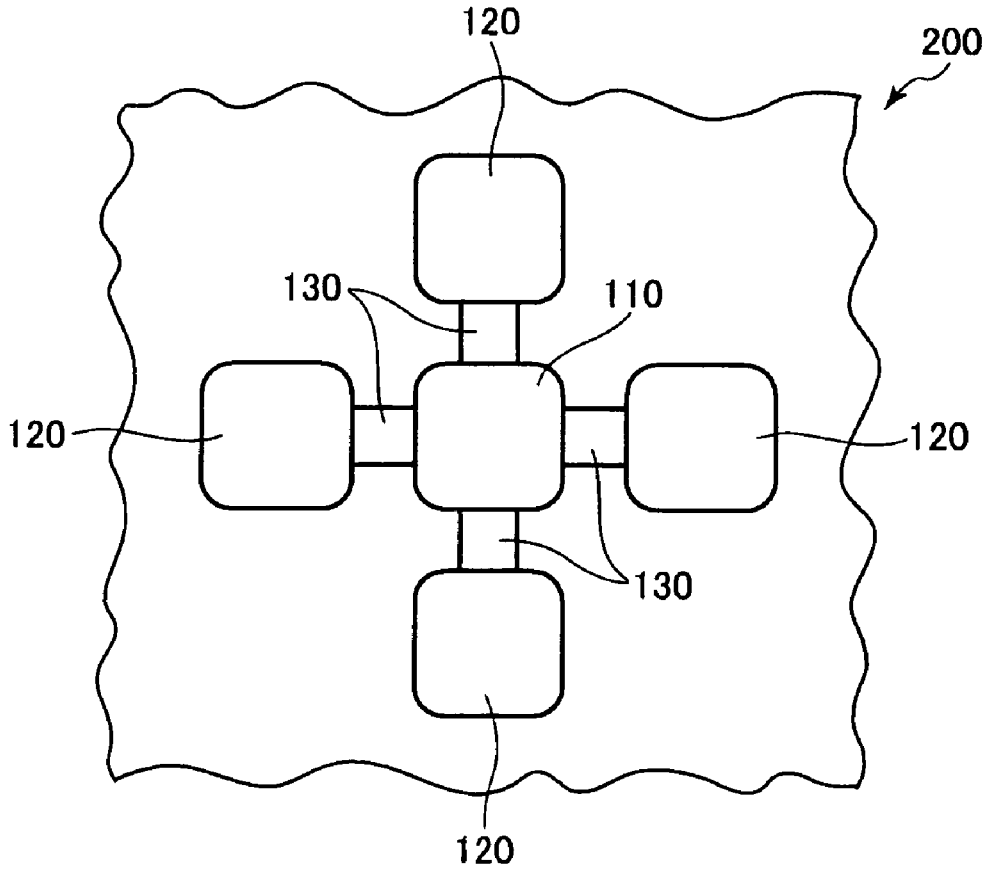
FIG. 9 is a plan view showing a modification to the die in the apparatus for manufacturing the coil component according to the embodiment.

While the method and apparatus for manufacturing coil components according to the present invention has been described in detail with reference to specific embodiments thereof, it would be apparent to those skilled in the art that many modifications and variations may be made therein without departing from the spirit of the invention, the scope of which is defined by the attached claims. For example, while the die 100 is formed with a single coil part accommodating cavity 120 for a single resin supplying cavity 110, as shown in FIG. 5, the number of coil part accommodating cavities 120 is not limited to this number. For example, in a die 200 shown in FIG. 9, a plurality of coil part accommodating cavities 120 are formed for a single resin supplying cavity 110. Since the hardened liquid resin 20' in the resin supplying cavity 110 and communicating channels 130 is discarded, this construction reduces the amount of discarded liquid resin 20' per number of coil components 1 manufactured, thereby improving the efficiency of manufacturing coil components 1.

Further, the apparatus for manufacturing coil components may also have a pressing device 240 for pressing down on the coil part so that the bottom surface 4A of the second flange 4 firmly contacts the bottom surface 121 of the coil part accommodating cavity 120. In this case, as shown in FIGS. 10-13, the pressing device 240 continues to press on the coil part at least after completing the introducing step and until the hardening step is completed. An apparatus with this construction ensures that the liquid resin 20' does not flow around the bottom surface 4A of the second flange 4, preventing the resin part 20 from being formed over the bottom surface 4A of the second flange 4. This construction can prevent the resin part 20 from covering the terminal electrodes 7 when the terminal electrodes 7 are provided on the second flange 4, for example. By applying pressure with the pressing device 240 in this way, the resin part 20 can be formed on only regions not receiving pressure. Since the resin part 20 is not formed on the bottom surface 4A of the second flange 4 and the bottom surface 5A of the first flange 5 in this case, the height of the coil component 1 along the axial direction of the winding portion 3 can be reduced. Further, by adjusting the shape of the coil part accommodating cavity 120 formed in the die 100, it is possible to provide the resin part 20 only to the winding portion 3 portion between the first and second flanges 5 and 4 or to ensure that the resin part 20 does not protrude farther outward than the first and second flanges 5 and 4 in a bottom view, for example.

Further, the flat bottom surface 111 of the resin supplying cavity 110 has the same depth as the bottom surface 121 of the coil part accommodating cavity 120, but the bottom surface 111 and the bottom surface 121 may be formed at different depths. Further, the bottom surface 131 of the communicating channel 130 is not limited to the depth described in the preferred embodiment. The bottom surface 131 is also not limited to a level flat surface as described in the preferred embodiment, but may be sloped, for example.

Further, while the liquid level controlling device 220 is provided to maintain the liquid resin 20' in the resin supplying cavity 110 at a prescribed level in the resin supplying step, the liquid level controlling device 220 may be eliminated. In this case, the operator must determine by sight whether the level of liquid resin in the resin supplying cavity 110 is at a prescribed position and may adjust the amount of resin supplied to the resin supplying cavity 110 in order to keep the level of resin at the prescribed position.

Further, while the liquid level controlling device 220 is provided to maintain the liquid resin 20' in the resin supplying cavity 110 at a prescribed level in the resin supplying step, the liquid resin 20' in the coil part accommodating cavity 120 may be maintained at a prescribed level by providing the liquid level controlling device 220 for the coil part accommodating cavity 120. In this case, the liquid level controlling device 220 for the coil part accommodating cavity 120 constitutes the liquid level controlling unit. The liquid level controlling device 220 for the coil part accommodating cavity 120 may be eliminated when the operator can monitor the level of liquid in the coil part accommodating cavity 120 by sight. In this case, the operator determines by sight when the level of liquid resin 20' is at a prescribed position and may adjust the amount of resin to be supplied to the resin supplying cavity 110 in order to keep the liquid resin 20' in the coil part accommodating cavity 120 at the prescribed level. By directly controlling the level of the liquid resin 20' in the coil part accommodating cavity 120 to the prescribed level, the level of liquid resin 20' in the coil part accommodating cavity 120 can be managed with great accuracy so that the resin part 20 is more accurately formed at the desired position on the coil part.

While the liquid level controlling device 220 is provided for the resin supplying cavity 110 in the resin supplying step to maintain the level of liquid resin 20' at a prescribed position in the resin supplying cavity 110, it is possible to instead provide a liquid level controlling device in the communicating channel 130 in order to maintain the level of liquid resin 20' in the communicating channel 130 at a prescribed level. This liquid level controlling device for the communicating channel 130 may be eliminated when the operator can monitor the level of liquid in the communicating channel 130 visually. In this case, the operator determines by sight when the level of liquid resin 20' is at the prescribed position and may adjust the amount of resin supplied to the resin supplying cavity 110 in order to keep the liquid resin 20' in the communicating channel 130 at the prescribed level.

In the preferred embodiment described above, the resin part 20 is a thermo-setting resin containing magnetic powder and is primarily configured of an epoxy resin hardener and ferrite that can be solidified upon heat application in the hardening step. However, the resin part 20 is not limited to this material. For example, the resin part 20 may be a two-component epoxy resin that hardens at a room temperature in the hardening step.

Further, the preheating device 230 is capable of preheating the die 100 to 40-80° C. prior to performing the resin supplying step, but rather than heating the entire die 100, the preheating device 230 may be configured to preheat the portion of the die 100 defining the resin supplying cavity 110, the portion of the die 100 defining the coil part accommodating cavity 120, and the portion of the die 100 defining the communicating channel 130.

Further, while the die 100 is formed of silicone, the die 100 may be configured of another deformable, elastic member formed of polystyrene-resin or the like.

Further, the shape of the coil component 1 is not limited to the shape described in the above-described embodiment, and the number of windings 6 is not limited to the number in the above-described embodiment. For example, while the region on the bottom surface 5A at which the second terminal electrode 7B is provided extends to the second borderline L2 connecting a point P3 on the third side 55 separated from the point P1 and a point P4 on the fourth side 56 separated from the point P2, as shown in FIGS. 2 and 3, the second terminal electrode 7B may be limited to a region connecting the entire length of the second omitted peripheral surface 54A to the entire length of the fourth omitted peripheral surface 58A. With this construction, it is still possible to maximize the electrode surface area in order to increase the bonding strength between the electrodes and the landing pattern on the circuit board during mounting. Since the surface area of the electrodes opposing the land pattern on the circuit board is increased, this construction can enhance self-alignment of the coil components 1 during reflow soldering.

Further, while a portion of the first terminal electrode 7A formed on the first omitted peripheral surface 53A and third omitted peripheral surface 57A extends an entire length of the first omitted side 53 and third omitted side 57, the portion of the first terminal electrode 7A on the first omitted peripheral surface 53A and third omitted peripheral surface 57A can extend less than the entire length of the first omitted side 53 and third omitted side 57. Similarly, while a portion of the second terminal electrode 7B formed on the second omitted peripheral surface 54A and fourth omitted peripheral surface 58A extends an entire length of the second omitted side 54 and fourth omitted side 58, the portion of the second terminal electrode 7B on the second omitted peripheral surface 54A and fourth omitted peripheral surface 58A can extend less than the entire length of the second omitted side 54 and fourth omitted side 58. Additionally, the same apparatus may be used in both the pre-heating step and the hardening step.

The invention claimed is:

1. A coil component comprising:

a core comprising a winding portion, and first and second flanges disposed one on either end of the winding portion;

a winding wound about the winding portion; and terminal electrodes disposed on the first flange;

wherein the first flange has a bottom surface constituting a first endface of the core, and a peripheral surface extending toward a second endface of the core from a peripheral edge of the bottom surface;

wherein the bottom surface is formed in an octagonal shape when viewed along a line connecting the first flange and the second flange and has a first omitted side, second omitted side, third omitted side, and fourth omitted side configured by chamfering or cutting an imaginary square-shaped bottom surface at a position corresponding to a first corner located on a first end of a first side forming the bottom surface, a position corresponding to a second corner located on a first end of a second side opposing the first side, a position corresponding to a third corner located on a second end of the first side, and a position corresponding to a fourth corner located on a second end of the second side;

wherein the peripheral surface has surfaces corresponding to all sides of the octagonal bottom surface, including a first peripheral surface extending from the first side, a second peripheral surface extending from the second side, a first omitted peripheral surface extending from the first omitted side adjacent to the first peripheral surface, a second omitted peripheral surface extending from the second omitted side adjacent to the second peripheral surface, a third omitted peripheral surface extending from the third omitted side adjacent to the first peripheral surface, and a fourth omitted peripheral surface extending from the fourth omitted side adjacent to the second peripheral surface;

wherein the terminal electrodes comprise a first terminal electrode and a second terminal electrode, the first terminal electrode being disposed across the first omitted peripheral surface, a part of the bottom surface covering at least a region linking an entire length of the first omitted side to an entire length of the third omitted side, and the third omitted peripheral surface, and the second terminal electrode being disposed across the second omitted peripheral surface, a part of the bottom surface covering at least a region linking an entire length of the second omitted side to an entire length of the fourth omitted side, and the fourth omitted peripheral surface; and wherein the winding has a first end electrically connected to the first terminal electrode on the first omitted peripheral surface, and has a second end electrically connected to the second terminal electrode on the second omitted peripheral surface.

2. The coil component according to claim 1, wherein the first end of the winding and the first terminal electrode on the first omitted peripheral surface, and the second end of the winding and the second terminal electrode on the second omitted peripheral surface are electrically connected to each other through diffusion bonding.

3. The coil component according to claim 1, wherein the first terminal electrode is disposed only on the first and third omitted peripheral surfaces among the octagonal peripheral surface, and the second terminal electrode is disposed only on the second and fourth omitted peripheral surfaces among the octagonal peripheral surface.

4. The coil component according to claim 1, further comprising a resin part covering a wound portion of the winding.

5. The coil component according to claim 4, wherein the resin part contains magnetic powder.

6. The coil component according to claim 1, further comprising a resin part covering an entire second flange and an entire wound part of the winding, wherein the peripheral surface and bottom surface of the first flange is free from covering with the resin part.

7. The coil component according to claim 1, wherein the bottom surface further has a third side connecting the first and second omitted sides and a fourth side connecting the third and fourth omitted sides; and wherein the first terminal electrode is disposed in a region of the bottom surface extending to a first borderline connecting a point on the third side to a point on the fourth side, and the second terminal electrode is disposed in a region of the bottom surface extending to a second borderline connecting a different point on the third side to a different point on the fourth side, the first and second borderlines being separated from each other.

* * * * *